United States Patent [19]

Gering et al.

[11] Patent Number: 4,963,314

[45] Date of Patent: Oct. 16, 1990

[54] GOLF SWING INSTRUCTIONAL DEVICE

[76] Inventors: George Gering, 8 Robbins La., Short Hills, N.J. 07078; Jay Benenson, 159 Millburn Ave., Millburn, both of N.J. 07041

[21] Appl. No.: 474,636

[22] Filed: Jan. 30, 1990

Related U.S. Application Data

[63] Continuation of Ser. No. 297,341, Jan. 17, 1989, abandoned.

[51] Int. Cl.[5] ..... A63B 69/36

[52] U.S. Cl. ..... 273/183 R; 273/183 A; 273/183 E

[58] Field of Search ..... 273/35 R, 183 R, 183 A, 273/183 E, 184 R, 186 R, 186 A, 186 C, 186 B, 186 D, 190 R, 1 GC, 1 E, 183 B; 434/252, 247, 22, 52

[56] References Cited

U.S. PATENT DOCUMENTS

| | | | |
|---|---|---|---|
| 3,508,440 | 4/1970 | Murphy | 273/184 R |
| 3,524,650 | 8/1970 | Brandell | 273/183 E |
| 4,000,904 | 1/1977 | Poortman | 273/183 E |
| 4,131,280 | 12/1978 | Poortman | 273/186 C |
| 4,180,270 | 12/1979 | Long | 273/186 R |
| 4,195,293 | 3/1980 | Margolin | 273/DIG. 28 |
| 4,251,077 | 2/1981 | Pziz et al. | 273/186 A |
| 4,336,018 | 6/1982 | Marshall et al. | 434/22 |
| 4,377,125 | 3/1983 | Westfall | 273/186 A |
| 4,431,156 | 3/1984 | Marshall et al. | 434/22 |
| 4,842,276 | 6/1989 | Darby | 273/1 GC |

FOREIGN PATENT DOCUMENTS

| | | | |
|---|---|---|---|
| 1536804 | 12/1978 | United Kingdom | 273/184 R |

OTHER PUBLICATIONS

An Engineering Approach to Digital Design, Fletcher, pp. 415–416, 1980.

*Primary Examiner*—William H. Grieb
*Assistant Examiner*—Dean Small
*Attorney, Agent, or Firm*—James & Franklin

[57] ABSTRACT

The sound of the swing of a golf club is sensed and actuates a circuit to randomly select one of a plurality of visually distinctive indicia, such as different colored LEDs or flags, for a fraction of a second. One set of indicia is located on the ground proximate the ball. In order to observe and identify the selected indicia, the golfer must keep his head down and steady during the swing. A second set of identical indicia may be provided for use by an instructor. The second set of indicia may be located remotely from the first.

8 Claims, 4 Drawing Sheets

GOLF SWING INSTRUCTIONAL DEVICE

This is a continuation of co-pending application Ser. No. 297,341 filed on Jan. 17, 1989 now abandoned.

The present invention relates to an instructional device for improving the golf swing and more particularly to an electronic apparatus which teaches a golfer to keep his head down and still throughout the backswing and impact segment of the golf swing.

Experienced and novice golfers alike have difficulty in maintaining their heads in the proper position throughout the backswing and impact segment of the golf swing. In order to teach the golfer to keep his head down and still, we have invented an electronic device designed to be situated proximate the tee which, in response to the sound of the swing of the club, will expose a selected one of several visually distinctive indicia for a brief period. While it is necessary that the golfers eyes be focused on the ball or practice swing target, he may correctly identify the selected indicia by viewing it in his peripheral range of vision during the contact phase of the swing. Hence, the golfer must keep his head down and still through the critical portions of the swing. By repeated use of the device, the golfer becomes accustomed to keeping his head in the appropriate position throughout the swing and will thereafter maintain his head in the correct position habitually.

We are aware of a product sold by Miya Epoch Inc. of 1635 Crenshaw Blvd., Torrance, California 90501 called Head Up Preventer which is designed for purposes similar to that of the present invention. That product senses the sound of the impact of the club with the ball and causes a red light to be energized for a given time period. It has only a single indicia and hence lacks the multiple indicia and the indicia selection capability of our invention. Because it has only a single indicia, the golfer can cheat the device as he need not observe the indicia to identify it. The multiple indicia has the additional advantage of demanding a higher degree of attentiveness on the part of the golfer in order to correctly identify the indicia which has been selected. With the golfer's mind repeatedly challenged, proper body positioning becomes habitual more easily and remains as a permanent part of the golfer's swing. The single indicia device, on the other hand, tends to bore the golfer, greatly reducing its effectiveness. Moreover, the Miya device has no separate set of indicia for use by an instructor. This also limits its usefulness as a teaching tool.

It is therefor, a prime object of the present invention to provide an instructional device for improving the swing of a golfer.

It is another object of the present invention to provide a golf swing instructional device which teaches the golfer to keep his head in the appropriate position throughout the backswing and impact segment of the golf swing.

It is another object of the present invention to provide a golf swing instructional device which includes multiple, visually distinctive indicia such as different colored LEDs or mechanical flags.

It is another object of the present invention to provide a golf swing instructional device which employs circuitry for randomly selecting one of several visually distinctive indicia.

It is another object of the present invention to provide a golf swing instructional device which includes a second set of identical indicia for use by an instructor.

It is another object of the present invention to provide a golf swing instructional device which is relatively simple in nature, uses conventional circuitry and is relatively inexpensive to manufacture.

In accordance with the present invention, an instructional device is provided for improving the swing of a golfer. The device includes means for sensing the movement of a golf club. Means are provided for generating an actuation signal in response to the sensing of the movement of the club. A plurality of visually distinctive indicia, normally not visible to the golfer, are provided. Means are provided for selecting one of the indicia, in response to the actuation signal, and for actuating the selected indicia to become visible for a given time period to permit identification thereof.

The sensing means preferably comprises sound sensing means such as a microphone or the like. The actuation signal generating means comprises amplification means for generating a pulse in response to the output of the sensing means. Preferably, sensitivity adjusting means are provided in conjunction with the actuation signal generating means. The actuation signal generating means further includes gating means for generating the actuation signal in response to the pulse.

The selecting means preferably comprises means for randomly selecting one of the indicia. The random selecting means comprises a shift register connected as a sequence generator. The shift register has a plurality of outputs, each of which is operably connected to actuate a different one of the indicia. The shift register further comprises a clock input. The clock input is operably connected to receive the actuation signal.

Preferably, the indicia are provided in a first set adapted to be situated proximate the teeing area visible to the golfer and a second identical set, visible to another, such as an instructor. The second set may be located remotely from the first.

Preferably the indicia may comprise light generating means such as an LED. Alternatively, the indicia may comprise different colored mechanical flags and means effective, in response to the output of the selection circuitry, for moving the selected one of the flags from a normal position, not visible by the golfer, to a position visible by the golfer. Preferably the flag moving means comprises a solenoid.

When LEDs or other light sources are employed, the visibility thereof may be reduced by direct sunlight. Accordingly, the device preferably comprises sunlight shielding means.

The device is designed to be situated on the ground or other surface proximate the tee. Support means are provided for this purpose. In order to permit the device to be angled such that the indicia are most visible, the support means preferably has position adjustable capability.

To these and such other objects which may hereinafter appear the present invention relates to a golf swing instructional device as described in detail in the following specification and as recited in the annexed claims taken together with the accompanying drawings where like numerals refer to like parts and in which:

Figure 7A:
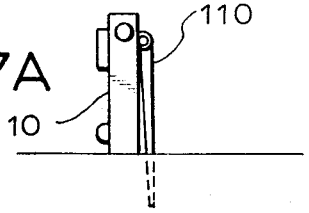
Figure 7B:
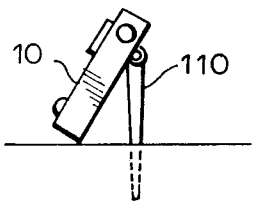
Figure 8:
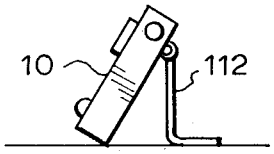
Figure 3A:
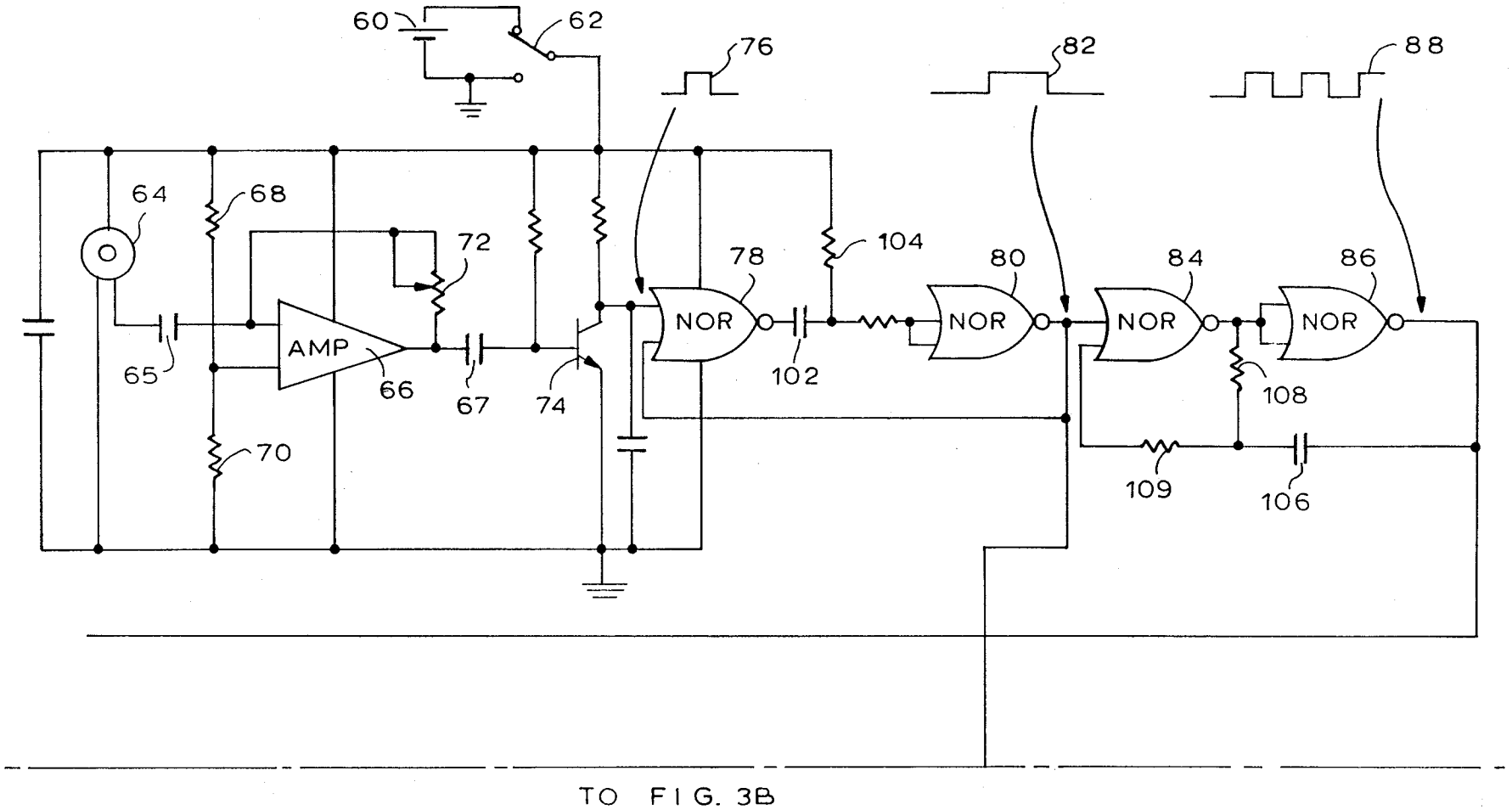
Figure 3B:
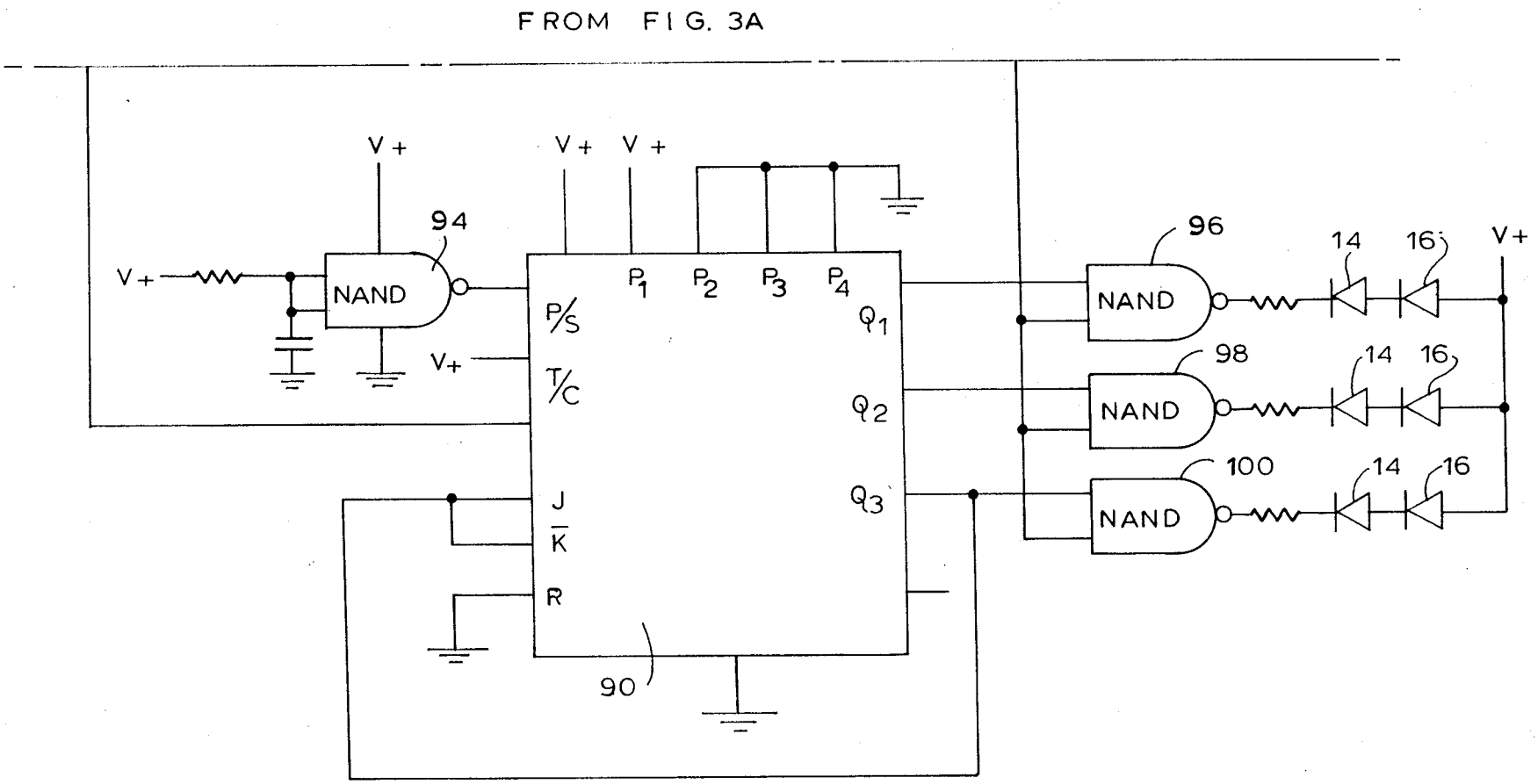
Figure 4:
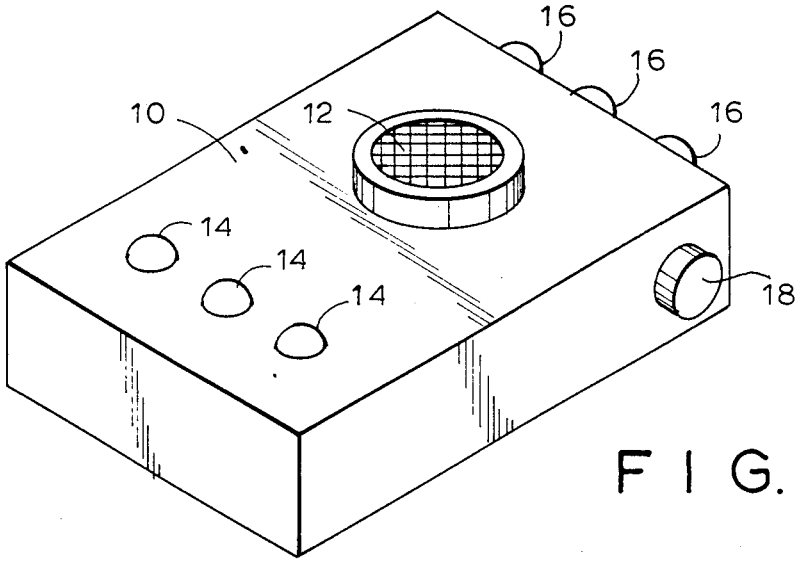
Figure 5:
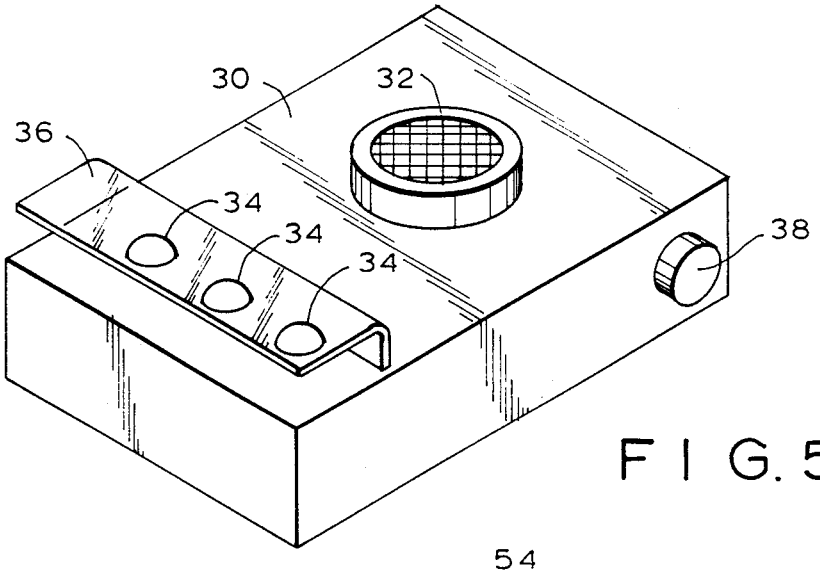
Figure 6:
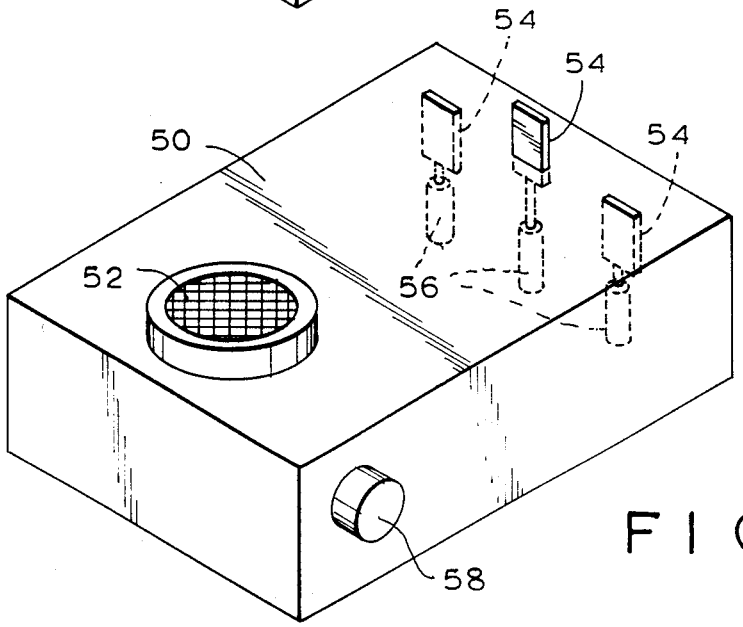

FIGS. 3*a* and 3*b* together are a schematic diagram of the circuitry of the present invention;

FIG. 4 is an isometric view of a first preferred embodiment of the present invention;

FIG. 5 is an isometric view of a second preferred embodiment of the present invention;

FIG. 6 is an isometric view of a third preferred embodiment of the present invention;

FIGS. 7*a* and 7*b* illustrate different positions of one form of the adjustable support means of the present invention;

FIG. 8 illustrates a second form of adjustable support means of the present invention.

As best seen in FIG. 4, the first preferred form of the present invention includes a housing 10, which may be made of metal or plastic, which encloses the electronic circuitry and upon which the indicia are mounted. On top of the housing is an opening 12, covered by a grate or mesh, through which sound vibrations may pass to an internally situated microphone. Also located on the top surface of the housing are a first set of indicia in the form of three light emitting diodes 14 which are of different colors, for example, red, green and blue. On the rear wall of housing 10 are a second set of identical indicia in the form of LEDs 16 which are visible from the rear of the housing. On one side wall of the housing is a control knob 18 which is used to adjust the sensitivity of the microphone. It will be appreciated that in the first preferred embodiment, both sets of LEDs 14 and 16 are contained within a single housing 10.

Figure 1:
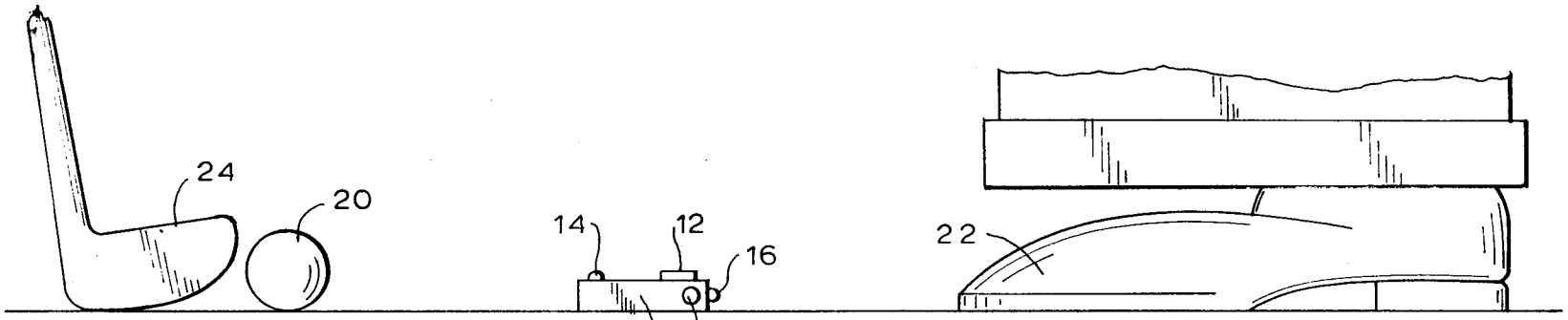
FIG. 1 is a schematic representation showing the placement of the device of the present invention in use with an instructor.

As illustrated in FIG. 1, in use, housing 10 is placed on the ground proximate the ball 20 which may be on a tee or not as desired. It should be appreciated that the device of the present invention can also be used without a ball, if desired, by adjusting the sensitivity of the microphone to detect the sound of the swing of the club instead of the sound of the impact of the club with the ball.

The device is placed so that the golfer can view the top surface of housing 10 and hence LEDs 14 when his head is in the appropriate position. Another person, such as an instructor 22, may stand at a position spaced from the rear wall of housing 10 and observe LEDs 16. When club 24 is swung, the sound vibrations travel through opening 12 and are picked up by the microphone within housing 10. The microphone signal causes a circuit to randomly select and actuate one of the LEDs (red, blue or green) in each set 14, 16, for a fraction of a second. If the golfer has maintained his head in the proper position during the swing, he will be able to identify the LED in set 14 which is actuated. The instructor will observe the second set of LED's 16 to insure that the LED identified by the golfer is the LED which was actuated.

FIG. 5 illustrates a second preferred embodiment of the present invention. The second preferred embodiment is essentially the same as the first preferred embodiment but includes a second housing for the second set of LEDs 16. The second housing can be located remotely from the first. FIG. 5 shows a first housing 30 similar to housing 10 with a sound transfer opening 32, a first set of LEDs 34 and a sound sensitivity control knob 38. It should be noted that there is no second set of LEDs on housing 30. FIG. 5, in addition, illustrates a sunlight shield 36 which can be used when the housing is in direct sunlight. Such sunlight may make it difficult for the golfer to identify which of the LEDs 34 has been actuated.

Figure 2:
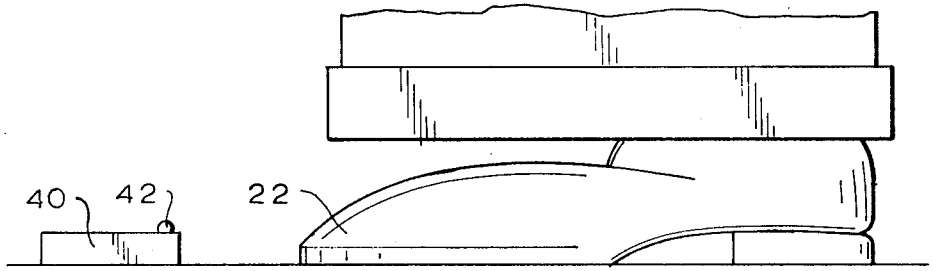
FIG. 2 is a schematic representation of a remote housing and second set of indicia for use by an instructor.

FIG. 2 shows a remote housing 40 upon which is situated the second set of LEDs 42. Housing 40 is designed to be placed at a location remote from housing 30 and proximate the instructor 22. Housings 30 and 40 are connected by wires, not shown.

FIG. 6 illustrates an embodiment of the present invention in which LEDs are replaced by differently colored mechanical flags. In this case, housing 50 has a sound transfer opening 52 and three differently colored flags 54. Flags 54 are normally situated below the top surface of housing 50 and hence obscured from view. However, when the appropriate solenoid 56 is energized, the selected flag will be momentarily thrust upwardly, above the top surface of housing 50, so that it can be observed. Housing 50 has a sensitivity adjustment control knob 58 on the side surface thereof.

FIGS. 3*a* and 3*b* are a schematic diagrams of the circuitry of the present invention. FIG. 3*a* illustrates the sound sensing and actuation signal generating circuitry. FIG. 3*b* illustrates the random selection and indicia actuation circuitry.

As seen in FIG. 3*a*, a battery 60, such as a 9 volt battery, supplies power to the entire circuit through an on/off switch 62. A microphone 64, of conventional design, is situated below the sound transfer opening of the housing and picks up sound vibrations from the swing of the golf club. The output of microphone 64 passes through a capacitor 65 and forms the negative input to an amplifier circuit 66, such as a CA741. The positive input to the amplifier circuit 66 is connected between resistors 68 and 70. The output of amplifier 66 is feb back to its negative input through a potentiometer 72 which provides the sensitivity adjustment. Potentiometer 72 is connected to the sensitivity control knob situated on the side of the housing.

After passing through a capacitor 67, the output of amplifier 66 forms the input to a control terminal of a transistor, such as a 2N2222, the emitter of which is grounded. The collector of transistor 74 generates a signal pulse 76 (illustrated above the circuit) to one input of a quad two input NOR gate 78, such as CD4001B. The output of NOR gate 78 is in turn fed to a second NOR gate 80, the output of which is a pulse of longer duration than pulse 76, illustrated as 82. It should be noted that the output of NOR gate 80 is fed back to one of the inputs of NOR gate 78. The output of NOR gate 80 is connected to one imprint of a third NOR gate 84. NOR gate 84 has its output fed back to one of its inputs through resistors 108 and 109. The output of NOR gate 84 is connected to the input of NOR gate 86, the output of which is the actuation signal in the form of a pulse train illustrated as 88. NOR gates 80, 84 and 86 can be of the identical type as NOR gate 78.

The output of NOR gate 86 forms the clock input to a four stage parallel in/parallel out shift register 90 such as a CD4035B. The shift register is connected as a sequence generator to randomly select one of its outputs $Q_1$, $Q_2$ or $Q_3$ and energizes same for a duration determined by the length of pulse 82.

The parallel/serial control input (P/S) of shift register 90 is connected to the output of NAND circuit 94, such as a CD40111B, which is a quad two input NAND gate. The J and $\overline{K}$ inputs are connected in feedback relation to the third output $Q_3$. The reset input R is grounded and the true/complement input (T/C) is provided with a positive voltage. Parallel inputs $P_2$ $P_3$ and $P_4$ are grounded and parallel input $P_1$ is provided with a positive voltage.

The $Q_1$, $Q_2$ and $Q_3$ outputs are respectively connected to one input of a different one of three NAND gates 96, 98, 100. These NAND gates may also be a CD4011B. The other input of each of the NAND gates 96, 98 and 100 is connected to the output of NOR gate 80 to receive pulse 92. The outputs of each of the NAND gates 96, 98 and 100 are connected respectively, through a resister, to a pair of similarly colored LEDs 14, 16, one in each set. Hence, the same colored LED in each set will be energized simultaneously.

The output of NOR gate 80, shown as pulse 82, determines the time during which the selected LED will be energized. It is preferable that the LED remain energized for approximately one third of a second. The duration of pulse 82 is determined by the value of capacitor 102 and resistor 104 and is preferably approximately 0.35 second.

The duty cycle of pulse train 88, which is the output of NOR gate 86, is determined by the value of capacitor 106 and resister 108. It is preferably in the order of 22 microseconds. This pulse train functions as a clock input to shift register 90.

For use with mechanical flags instead of LEDs, three solenoids 56 are driven by the outputs of the NAND gates 96, 98 and 100 instead of the LEDs. The solenoids are preferably spring loaded to return the flags to their hidden positions promptly after the NAND gates are deenergized.

Because the device of the present invention is intended for use by golfers of different heights and under different lighting conditions, it is preferable to provide housing 10 with a position adjustable support such as illustrated in FIGS. *7a*, *7b* and 8. FIGS. *7a* and *7b* show a spike-like support 110 for use on dirt, grass or other surface which can be penetrated. FIG. 8 illustrates an L-shaped support for use on a solid surface such as a gym floor or the like. In each case, the support is pivotally connected to the undersurface of the housing such that the housing can be situated either vertically, horizontally or at any inclination therebetween.

It should now be appreciated that the present invention relates to a golf swing instructional device designed to teach the golfer to keep his head down and still during the swing. The device includes a plurality of visually different indicia, one of which is randomly selected and actuated for a short time in response to the detection of the sound of the swing of the golf club.

By providing randomly selected differently colored indicia, it is necessary that the golfer maintain visual contact with the housing during the critical portion of the swing to enable him to identify which of the indicia has been selected. For use by an instructor, a second set of indicia, either located on the main housing or on a housing remotely situated from the main housing may be utilized. In order to make the indicia more visible to direct sunlight, a sunlight shield may be provided. In addition, a position adjustable support means are provided so that the inclination of the device can be adjusted as necessary.

While only a limited number of preferred embodiments have been provided for purposes of illustration, it is obvious that many variations and modifications could be made thereto. It is intended to cover all of these variations and modifications which fall within the scope of the present invention as defined by the following claims:

We claim:

1. An instructional device for improving the golf swing comprising means for sensing the sound of a golf club striking a ball, means for generating an actuation pulse in response to the sensing of the sound of the ball being struck, means for generating a series of clock pulses in response to said actuation pulse, selection means having a plurality of outputs and an input, said input being operably connected to receive said clock pulses, said selection means randomly selecting one of said plurality of outputs, in response to said clock pulses, a first plurality of visually distinctive energizable indicia, means for receiving said actuation pulse and for operably connecting said indicia with said random selection means to energize one of the said indicia associated with the randomly selected output for the duration of said actuation pulse.

2. The device of claim 1 wherein said actuation signal generating means comprises amplifier means for generating said actuation pulse in response to the output of said sensing means.

3. The device of claim 2 wherein said actuation signal generating means comprises sensitivity adjusting control means.

4. The device of claim 2 wherein said actuation signal generating means further comprises means for generating said actuation signal for a given time period after receiving the output of said amplifier means.

5. The device of claim 1 wherein said indicia comprise light generating means.

6. The device of claim 5 wherein said light generating means comprise light emitting diodes.

7. The device of claim 1 wherein said indicia comprise means for generating light of different colors.

8. The device of claim 1 further comprising a second plurality of visually distinctive energizable indicia remotely and physically located from said first plurality of indicia, means for energizing one of said indicia from said second plurality of indicia to correspond with the selected indicia from said first plurality of indicia, whereby the second plurality of indicia are easily viewable by an instructor.

* * * * *